US006233768B1

(12) United States Patent
Harding

(10) Patent No.: US 6,233,768 B1
(45) Date of Patent: May 22, 2001

(54) MULTIPLE AIR CHAMBER CONTOURED MATERNITY MATTRESS

(76) Inventor: Diane Harding, 10455 Oakdale Ave., Chatsworth, CA (US) 91311

( * ) Notice: Subject to any disclaimer, the term of this patent is extended or adjusted under 35 U.S.C. 154(b) by 0 days.

(21) Appl. No.: 09/339,918

(22) Filed: Jun. 25, 1999

(51) Int. Cl.[7] ..... A47C 27/08
(52) U.S. Cl. ..... 5/735; 5/706; 5/930
(58) Field of Search ..... 5/631, 638, 710, 5/724, 725, 735, 655.3, 706, 930

(56) References Cited

U.S. PATENT DOCUMENTS

D. 392,145 * 3/1998 Thurston ..... 5/735 X
D. 403,194 * 12/1998 Thurston ..... 5/735 X
4,054,960 * 10/1977 Pettit et al. ..... 5/631
5,425,147 * 6/1995 Supplee et al. ..... 5/735 X
5,720,061 * 2/1998 Giori et al. ..... 5/735
5,890,246 * 4/1999 Davis ..... 5/735

* cited by examiner

*Primary Examiner*—Lynne H. Browne
*Assistant Examiner*—Fredrick Conley
(74) *Attorney, Agent, or Firm*—James F. Cottone

(57) ABSTRACT

An improved maternity mattress is formed from a number of separately inflatable air chambers and a number of internally disposed shape retaining and weight supporting structures which functionally combine to significantly increase the comfort and well being of pregnant women over the course of their pregnancy. Integrally formed within the mattress is a womb well of high shape integrity that is adjustably fillable by use of a hierarchy of interfitting pillows, as well as physical arrays of gussets to preserve mattress shape and integrity, and comfort baffles to optimally support body weight as it is distributed over a longitudinally contoured upper mattress surface.

10 Claims, 2 Drawing Sheets

MULTIPLE AIR CHAMBER CONTOURED MATERNITY MATTRESS

TECHNICAL FIELD

The present invention relates generally to an air mattress adapted for supporting pregnant women, and more particularly to a specially configured mattress that includes a plurality of distinct air chambers and internally positioned gussets and baffles to optimize its weight supporting properties and its shape integrity and dynamic stability while in use.

BACKGROUND

Methods and apparatus for providing a resting or sleeping environment for pregnant women have a long history of development. As pregnancy progresses, a woman's ability to find a comfortable resting position on conventional mattresses decreases significantly. In past years, this has led to the development of many types of mattresses having a suitably located central cavity to accommodate the distended abdomen. However, the degree and orientation of abdomen expansion changes dramatically over time, and a mattress with a more or less static cavity size, or other fixed attributes, cannot provide the needed comfort and other health benefits for the full range of fetus development.

Recently, air mattresses of various types have been proposed, some of which have moved the pregnancy mattress art in useful directions. The basic ability of an inflatable air mattress does allow for a certain amount of dynamic accommodation over time.

Descriptions of typical prior art approaches to air mattresses for pregnant women may be found in a number of U.S. patents. Consider first U.S. Pat. No. 5,819,348 to Ryan, which teaches the use of a number of separate inflatable cells of various sizes to allow adjustability of a womb well formed into an inflatable maternity mattress.

An even earlier 1976 patent, U.S. Pat. No. 3,988,793 to Abitbol, discloses the technique of using individually inflatable oval-shaped sections within an air mattress for pregnant women such that the user can establish the degree of firmness desired. A separately operable vacuum pump operates on a bottom chamber portion of an abdomen supporting section to relieve unwanted pressures on various physiological structures, such as the abdomen aorta.

Additionally, many U.S. design patents suggest other more or less similar approaches with U.S. design Pat. No. 348,792 to DeGroot, and U.S. design Pat. No. 350,586 to Francis, being typical ones.

Beyond the maternity mattress teachings, a number of prior art mattress are of cumulative interest. U.S. Pat. No. 4,329,748 to Finkelstein, discloses the use of an array of flexible structures interiorly located within inflatable structures (a waterbed in this case) for the purpose of providing shape and load control.

U.S. Pat. No. 2,741,780 to Kimbrig discloses the broad technique of employing internal partitions to minimize upward and outward bulging of the top and sidewalls of an inflatable mattress core.

U.S. Pat. No. 2,807,033 to Austen discloses an early (1957) teaching of forming a plurality of interconnected openings into a sponge rubber mattress to support comfortable breathing when a person is lying on his stomach.

While each of these prior art teachings appear to be addressing selected aspects of providing an ideal resting or sleeping medium for pregnant women—or indeed for persons in general or obese or infirm persons—they have not addressed the full range of attributes needed. It is especially this comprehensive set of physical needs that the present invention admirably meets, with its specially configured combination of contouring, separate air chambers, and shape integrity retaining internal baffles and gussets.

OBJECTS OF THE INVENTION

It is therefore a primary object of the present invention to provide an improved air mattress for pregnant women which will overcome the disadvantages of the prior art approaches and devices.

A further object of the present invention is to provide an improved maternity mattress which includes a range of internal structures that function in combination to provide increased shape adjustability, shape integrity, and dynamic stability.

A still further object of the present invention is to provide a multiple chambered maternity mattress including a separate high pressure air chamber for the user's head, a separate horseshoe shaped face rest pillow, and a main air chamber for optimally distributing body support.

A yet further object of the present invention is to provide a centrally disposed womb well in its main mattress air chamber to accommodate a user's expanded abdomen, including a range of inter-fitting pillows to allow for minor and major adjustability over the course of a pregnancy.

An additional object of the present invention is to provide an array of interiorly located gussets and baffles which function in combination to provide spatially distributed body weight support, mattress shape integrity, and dynamic stability in use.

In a preferred embodiment, a twin sized air mattress is formed to include a small high pressured head chamber at the head end of a longitudinally contoured air mattress having a separately inflatable larger main air chamber. A horseshoe shaped separately inflatable face pillow is affixed to the top surface of the head chamber and serves as a collar around the upper terminus of a breathing tube which is diagonally and downwardly disposed within the head chamber to facilitate breathing by a person lying face down on the mattress. An elliptical womb well is centrally disposed in the main air chamber and may be fitted with a plurality of interfitting pillows to accommodate changes in abdomen size and shape over time. Additionally, a plurality of internal baffles and gussets provide shape integrity and dynamic and static support for both the mattress and the body weight it carries.

BRIEF DESCRIPTION OF THE DRAWINGS

Additional objects and advantages of the invention will become apparent to those skilled in the art as the description proceeds with reference to the accompanying drawings wherein.

BEST MODE FOR CARRYING OUT THE INVENTION

Figure 1:
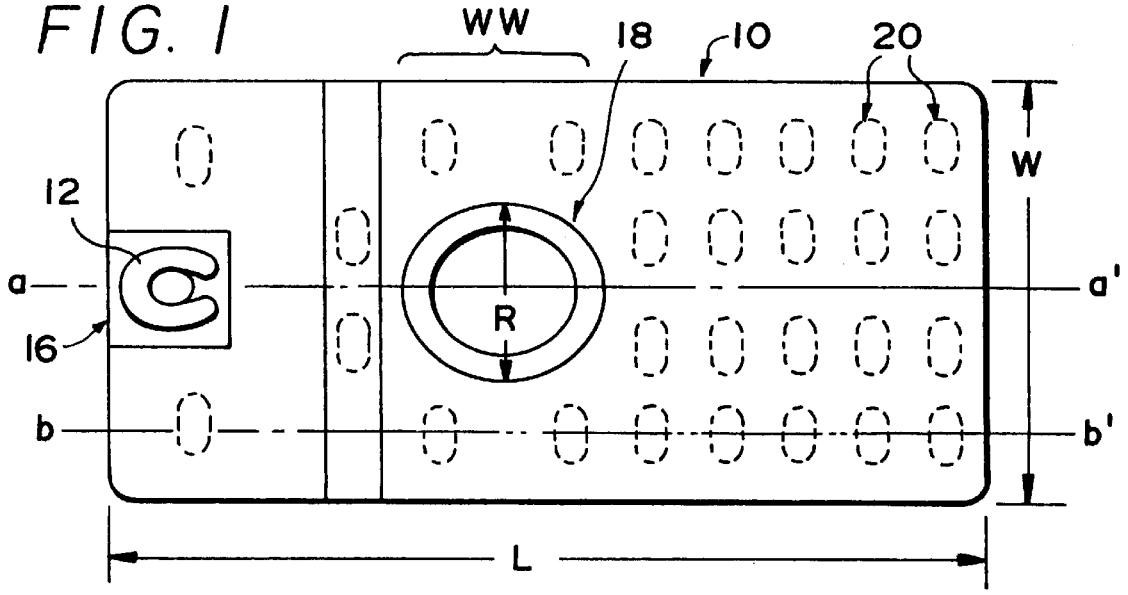
FIG. 1 is a top plan view of an improved air mattress for pregnant women according to the present invention.

Referring now to FIG. 1, there is shown a top plan view of an improved multiple air chamber contoured maternity mattress according to the present invention.

Figure 2:
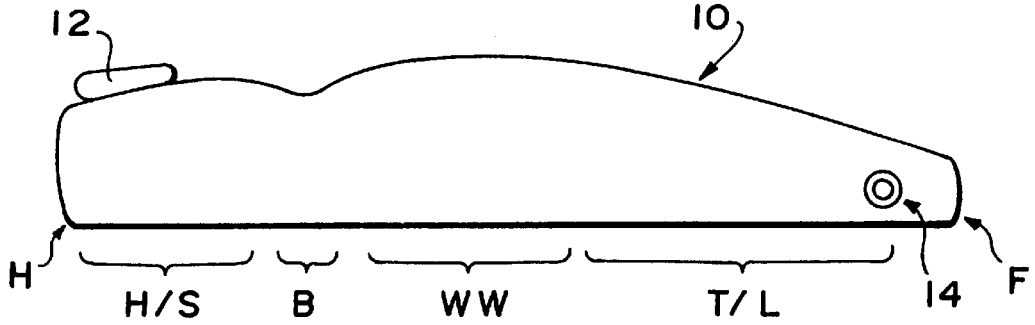
FIG. 2 is a right side elevational view of the air mattress of FIG. 1.

By way of a brief overview, refer also to FIG. 2 which shows a right side elevation of the maternity mattress. A contoured maternity mattress 10 is shown as being of generally rectangular form, having a length L, taken along a central longitudinal axis a–a', and a width W, taken along an orthogonal transverse axis (not shown). To provide the desired comfort and other benefits to a user, the height of mattress 10 varies smoothly along its length from a low of a nominally six inches at a foot end F, to nominally 10 inches at a head end H. Between these two ends are four distinctly contoured regions defined by smoothly varying heights which contribute to providing the benefits as described fully below. A first head and shoulders region H/S rises gently in height from the head end H toward its mid-section, and thereafter gently slopes down to a low point of nominally nine inches in a breast indentation region B. A third womb well region WW again rises gently from the low of region B to a height of nominally 14 inches near its mid-section, and thereafter smoothly tapers down through a thigh and leg region T/L to the low height point at foot end F.

The mattress 10 includes a face rest pillow 12 securely affixed to an upper head end of its region H/S, shown as being generally rounded in cross section and of horseshoe overall shape, and further includes a main inflation valve of 14 on its right side wall near the foot end F. The inflation valve 14 allows inflation of the major portion of mattress 10, except for a smaller high pressure chamber 16, shown as approximately rectangular in plan, and centrally located at the head end F. As best seen in FIG. 1, the womb well region WW includes a centrally disposed womb well opening 18, and further shows a plurality of comfort baffles 20 whose top surface attachment lines are shown in dashed lines. A top opening of the womb well 18 is elliptically shaped and may have a minor axis R dimension of nominally 14 inches. The top surface outlines of the comfort baffles depict their race track-like horizontal cross sections, and 28 of them (illustratively) are shown distributed in a pre-determined pattern throughout the extent of the mattress 10.

In a preferred embodiment, the maternity mattress 10 may be made largely of heavy gauged poly vinyl chloride (PVC). Preferably, the mattress is of twin size with dimensions of six feet four inches in length, and three feet in width. Up to this point, three separately inflatable chambers are provided, including a main mattress air chamber inflatable via the valve 14, the high pressure chamber 16, and the face rest pillow 12. Full details on these elements, regions and chambers described thus far, as well as others yet to be described, along with their interactive functions and benefits are provided below.

As is well known, air mattresses generally, as well as water mattresses and similar fluid filled, flexible devices, exhibit highly undesirable supporting instabilities when carrying dynamic loads, such as an articulated moving person. These instabilities are particularly detrimental when supporting pregnant women (as well as obese persons) because it is very difficult if not impossible for the user to achieve a comfortable position and maintain it thereafter. The slightest amount of user motion triggers off mattress shape/user weight flexing interactions that tend to induce unwanted other relative motions that negate the comfort previously achieved. It is exactly these instabilities that the present mattress minimizes so that the comfort and other benefits provided via the array of shapes, contours, separate chambers and other structures built in to the mattress 10 are not transitory.

Figure 3:
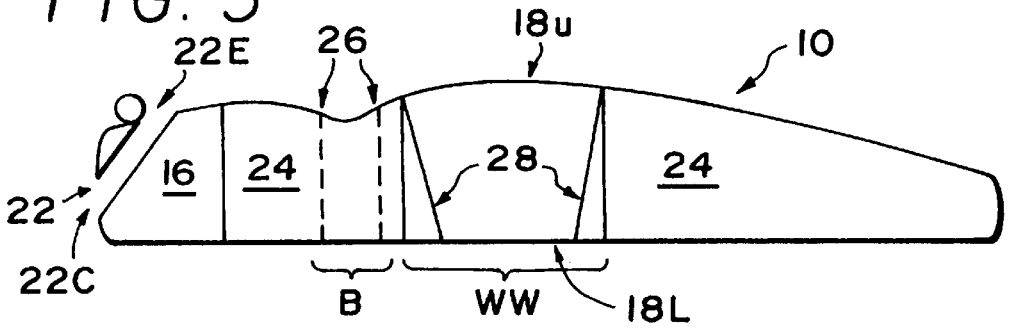
FIG. 3 is a longitudinal cross-sectional view taken along the line a–a' of FIG. 1.

Referring now to the longitudinal cross-sectional view of FIG. 3, a group of unique structural features are described in detail. The high pressure chamber 16 is inflatable via a valve (not shown), extends for the entire height of its portion of the head end of the H/S region, and carries a breathing tube 22 diagonally through it. The breathing tube 22 extends between the top surface of mattress 10 and the vertical surface wall at the head end H. Its upper elliptical opening 22E fits within the horseshoe shaped center of the face rest pillow 12, and its lower circular opening 22C exits the vertical wall surface at its mid-height. The face rest pillow 12 also has a separate inflation valve (not shown). In use, the small high pressure chamber 16 is inflated to achieve an individually adjustable degree of firmness for each user. Its size and location is optimized to support a user's head, and keeps the air directly under it from moving out from under its load. The pillow 12 is similarly individually adjustably inflated so as to optimally support a user's face as she lies face down on the mattress 10. The pillow 12 aids the chamber 16 in keeping the user's head and neck aligned, while the breathing tube 22 allows the user to breathe comfortably while lying face down on the mattress 10. Whereas the various other outer surfaces of the mattress 10 may be coated by a blue soft flock (for user comfort) that is impregnated into the vinyl as it is being made, the breath carrying surface of the breathing tube 22 is not so coated. Indeed, preferably the breath tube 22 may be lightly scented to impart air freshness. Note that the remainder of the mattress 10, particularly the previously mentioned main air chamber, shown as 24, is inflatable as a whole via the valve 14 with the high pressure air chamber 16 being the only excepted portion.

The breast indentation region B extends transversely across the mattress 10 and is supported in shape by a pair of gussets 26 shown in dashed lines. The gussets 26 are positioned so as to straddle the region B, and extend for the entire width of the mattress 10. They are approximately nine inches in height, and include a number of holes in their interior mid-sections to allow air in main air chamber 24 to flow freely through them as it is inflated. The size, location and strength of the gussets 26 greatly improve the shape integrity of the mattress 10 and the region B, and therefore contribute to its overall stability.

Figure 5:
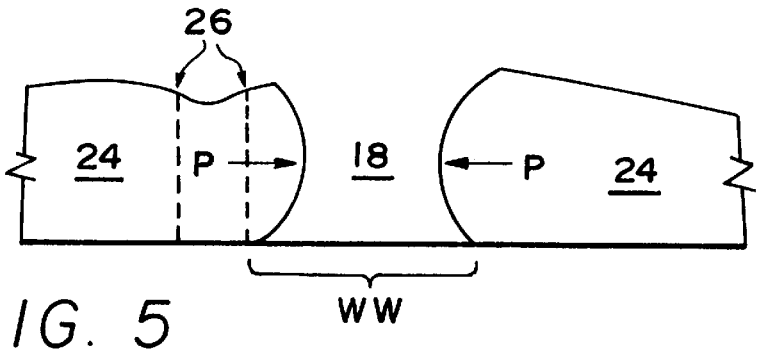
FIG. 5 is a partial cross-sectional view taken longitudinally across the womb well showing the effect of omitting a shape conforming baffle due to main air chamber air pressure.
Figure 6:
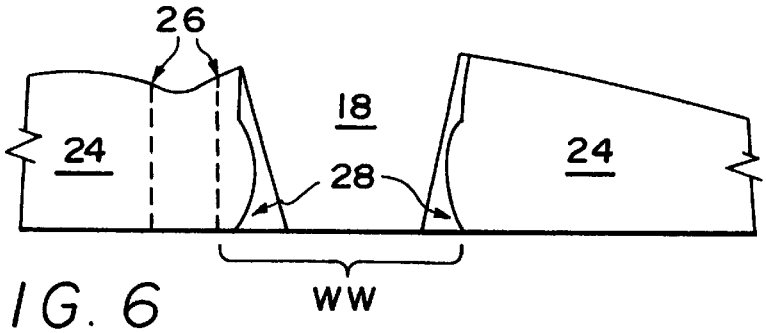
FIG. 6 is a partial cross-sectional view taken longitudinally across the womb well showing the improved shape integrity resulting from inclusion of the shape conforming baffle.

The compound shaped womb well region WW includes a volumetric opening—the womb well 18 which is shaped to accommodate the extending abdomen of a pregnant woman—that extends for the entire height of the mattress 10. The womb well 18 has the general shape of a truncated conic section but with an elliptical cross-section of tapering size throughout, with its semi-major axis aligned longitudinally. An upper or top elliptical opening 18U is larger than a lower or bottom elliptical opening 18L, and a shape conforming baffle section 28 welded to the top and bottom layers of the mattress 10 greatly assists in maintaining the tapered shape of the womb well 18. The baffle 28 forms a dead air space in open but controlled communication with the air in chamber 24. As the main air chamber 24 is inflated, the conforming baffle rises with it and presses in at the weakest mid-point of the walls. Brief reference to FIG. 5 shows what the inside shape of the womb well 18* might look like in cross-section in the absence of the baffle 28; FIG. 6 shows what the inside shape of womb well 18 looks like in cross section with the inclusion of this unique baffle structure. Clearly, in the absence of this baffle 28, the air in the main air chamber 24 would press in on the walls of the womb well 18 (as shown by the two pressure arrows P) putting unwanted and misdirected pressure on the user's abdomen.

Figure 4:
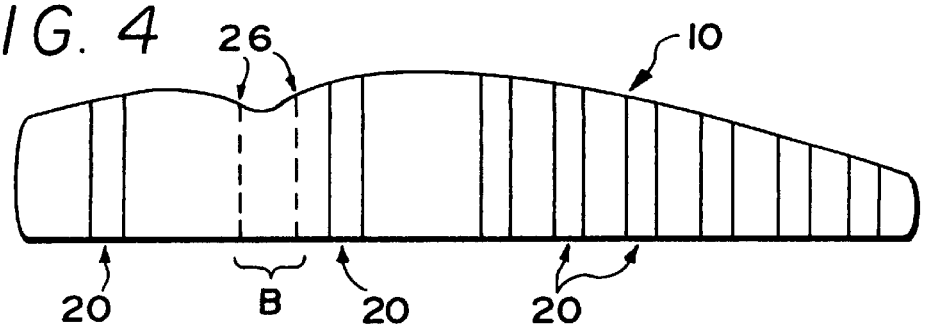
FIG. 4 is a longitudinal cross-sectional view taken along the line b–b' of FIG. 1.

Referring now to FIG. 4, there is shown a longitudinal cross-sectional view of the mattress 10 taken along the line b–b' of FIG. 1. Note that this figure, as compared to FIG. 3, shows only the interior location of the shape gussets 26, and the location and spatial distribution of several of the comfort baffles 20. As can be clearly inferred from the distribution of the baffles 20 shown, they are positioned to support body weight to maintain mattress shape integrity while providing the ideal firmness under the various body portions—head, breasts, torso and thighs/legs.

Figure 7:
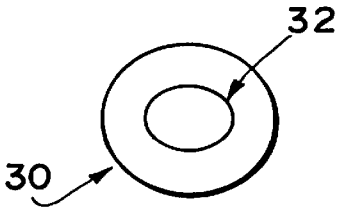
FIG. 7 is a plan view of a first smaller sized womb well pillow.
Figure 9:
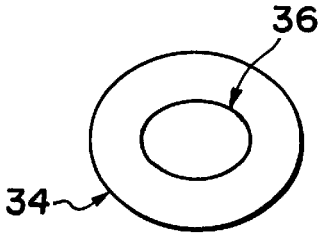
FIG. 9 is a plan view of a second larger sized womb well pillow.
Figure 8:
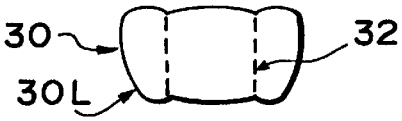
FIG. 8 is a side elevation of the womb well pillow of FIG. 7.
Figure 10:
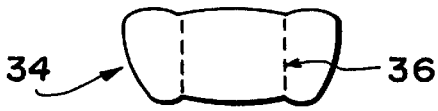
FIG. 10 is a side elevation of the womb well pillow of FIG. 9.

FIGS. 7 and 8 show a plan view and a side elevation plan and side elevations, respectively, of the first of a pair of separately inflatable womb well pillows which are made to fit into the womb well 18 to support a user's abdomen during various stages of pregnancy. The pair have the overall shape of a truncated tapered ellipse in cross-section, and include interiorly disposed shape maintaining baffles. A smaller pillow 30 is sized so that its lower extremity 30L mates snugly with the lower opening 18L of the womb well 18. An elliptical shape maintaining baffle 32, which functions similarly to the previously described comfort baffles 20, is formed within the pillow 30. FIGS. 9 and 10 show a larger pillow 34 of the pair, including a lower extremity 34L which is sized to match nominally the upper dimension of the small pillow 30, and a suitably sized, elliptical shape maintaining baffle 36. Both pillows are individually inflatable to the desired degree of firmness by separate inflation valves (not shown). In use, the smaller (or both) pillow(s) may be employed during early stages of pregnancy, and one or both pillows may be successively removed, or partially deflated, to accommodate later stages.

Figure 11:
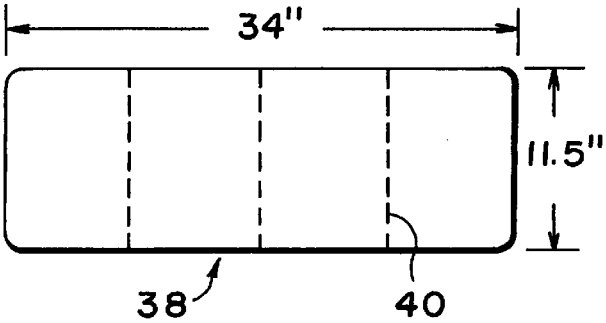
FIG. 11 is a plan view of a foot rest pillow adapted for auxiliary use with the mattress of FIG. 1.
Figure 12:
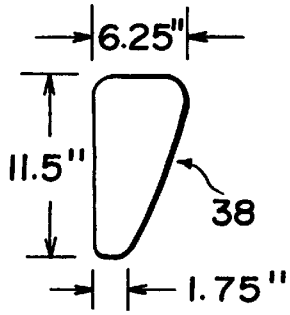
FIG. 12 is a side elevation of the foot rest pillow of FIG. 11.

FIGS. 11 and 12 show a plan view and side elevational view, respectively, of a foot rest pillow configured for auxiliary use with the maternity mattress 10. A foot rest pillow 38 is separately inflatable (via a valve not shown) to assume a generally rectangular shape in plan, with a length of approximately 34 inches to correspond to the nominal width W of the mattress 10, and a width of just under one foot. Overall dimensions for a preferred embodiment are as shown in the two figures. Four shape maintaining internally formed gussets, of which gusset 40 is typical, provide the shape integrity retaining action after inflation under load, as previously described in connection with the actions of gussets 26. In use, the foot rest pillow 38 is not attached to the mattress 10, and has optional use either as an angled foot rest to elevate tired and or swollen feet, or alternatively as an auxiliary pillow for the head and shoulders.

Although the invention has been described in terms of selected preferred embodiments, the invention should not be deemed limited thereto, since other embodiments and modifications will readily incur to one skilled in the art. It is therefore to be understood that the appended claims are intended to cover all such modifications as fall within the true spirit and scope of the invention.

What is claimed is:

1. A multiple chambered maternity mattress comprising:

an inflatable main air chamber having a womb well centrally disposed therein for accommodating a user's abdomen;

a separately inflatable head supporting air chamber integrally formed into a head end of said mattress, and extending for less than the width of said mattress;

a separately inflatable horseshoe shaped face rest pillow firmly affixed to an upper surface of said head air chamber;

a breathing tube extending diagonally through said head air chamber, having an upper opening surrounded by said face rest pillow and a lower opening in a forward vertical wall of the head end of said head air chamber; and a plurality of gussets and baffles disposed within said main air chamber for providing shape integrity, weight distribution, and dynamic stability of said mattress.

2. The maternity mattress of claim 1 wherein said main air chamber and head air chamber form a single substantially rectangular in plan view mattress which is smoothly contoured in height to form four distinct body supporting regions, comprising: a first convex head and shoulders region, a second concave breast indentation region, a third compound womb well region and a fourth downwardly tapering thigh and leg region, all of which are successively distributed along a central longitudinal axis extending from an outboard extremity of said head and shoulders region, and throughout said second and third regions to an outboard extremity of said thigh and leg region.

3. The maternity mattress of claim 2 wherein a first set of gussets transversely disposed surrounding said breast indentation region provide shape stability and integrity to said region.

4. The maternity mattress of claim 2 wherein said main air chamber further includes a plurality of baffles distributed throughout said four regions, each of said baffles extending between an underside surface of a top surface layer of said main air chamber and an upper side surface of a bottom surface layer of said main air chamber so as to enclose an air volume in fluid communication with the air in said main air chamber, said distributed baffles including at least two baffles in each of said four regions.

5. The maternity mattress of claim 2 wherein said womb well is elliptical in cross-section with its major axis longitudinally oriented and its cross-section decreasingly tapered from an upper opening to a lower opening in said main air chamber, said mattress further including a shape conforming baffle surrounding said womb well to provide shape integrity to said womb well region on inflation of said main air chamber.

6. The maternity mattress of claim 5 further including at least one separately inflatable womb well pillow sized and shaped to fit snugly within said womb well for adjustably accommodating a user's abdomen as the abdomen varies in size and shape.

7. The maternity mattress of claim 1 further including a separately deployable foot rest pillow sized to conform to the width of said main air chamber, said foot rest pillow being substantially rectangular in plan view, and of tapered cross-section for supporting either a foot portion or a head and shoulder portion of a user to enhance the user's body weight supporting capabilities of said mattress.

8. A multiple chambered air mattress which is smoothly contoured in height to form four distinct body supporting regions, including a first convex head and shoulders region, a second concave breast indentation region, a third compound womb well region and a fourth downwardly tapering thigh and leg region, comprising:

(a) an inflatable main air chamber having a womb well of elliptically shaped cross-section centrally disposed along a longitudinal axis extending from a head end to a foot end of said main air chamber, said womb well having upper and lower openings defining a truncated, tapering elliptical volume for accommodating a user's abdomen;

(b) a separately inflatable head air chamber integrally formed within a head end of said mattress, said head air chamber extending for less than one-third of the width and for less than one-eighth of the length of said main air chamber;

(c) a horseshoe shaped face rest pillow firmly affixed to an upper surface of said head air chamber for supporting the head or face or neck of a user, said face rest pillow being separately inflatable for adjustable user comfort and oriented with the opening end of said horseshoe shape facing a neck end of a user's head;

(d) a breathing tube extending diagonally through said head air chamber, said tube having an elliptically shaped upper opening located within a central portion of said face rest pillow and a circularly shaped lower opening located in an outboard wall of the head end of said head air chamber for allowing comfortable breathing of a user lying face down;

(e) a first plurality of gussets transversely disposed around said breast indentation region to provide shape stability and integrity to said region;

(f) a plurality of baffles distributed within said main air chamber, each of said baffles extending between an underside surface of a top surface layer of said main air chamber and an upper side surface of a bottom surface layer of said main air chamber so as to enclose an air volume in fluid communication with air in said main air chamber, said distributed baffles including at least two baffles in each of said four regions; and (g) a shape conforming baffle surrounding said womb well to provide shape integrity to said womb well region on inflation of said main air chamber.

9. The maternity mattress of claim 8 wherein said main air chamber and head air chamber are smoothly contoured in height to form four distinct body supporting regions defined as: a first convex head and shoulders region, a second concave breast indentation region, a third compound womb well region, and a fourth downwardly tapering thigh and leg region, all of which are successively distributed along a central longitudinal axis extending from an outboard extremity of said head and shoulder region, and throughout second and third regions to an outboard extremity of said thigh and leg region.

10. The maternity mattress of claim 8 adapted to received at least one separately inflatable womb well pillow sized and shaped to fit snugly within said womb well for adjustably accommodating a user's abdomen as the abdomen varies in size and shape.

* * * * *